US005294114A

United States Patent [19]

Stillinger

[11] Patent Number: 5,294,114

[45] Date of Patent: Mar. 15, 1994

[54] GAME PADDLE AND COMBINATION

[75] Inventor: Scott H. Stillinger, Los Gatos, Calif.

[73] Assignee: OddzOn Products, Inc., Campbell, Calif.

[21] Appl. No.: 990,538

[22] Filed: Dec. 10, 1992

Related U.S. Application Data

[63] Continuation of Ser. No. 632,956, Dec. 21, 1990, abandoned.

[51] Int. Cl.[5] ..... A63B 59/00

[52] U.S. Cl. ..... 273/67 R; 273/73 R

[58] Field of Search ..... 273/67 R, 67 B, 73 R, 273/73 E, DIG. 8, 76, 411, 72 R, 72 A, 26 B, 29

[56] References Cited

U.S. PATENT DOCUMENTS

| | | | |
|---|---|---|---|
| 42,834 | 5/1864 | Caminoni | 273/67 R |
| 519,770 | 5/1894 | McNaughton . | |
| 702,697 | 6/1902 | Boulanger | 273/73 R |
| 3,048,399 | 8/1962 | Breitbach | 273/72 R |
| 3,162,443 | 12/1964 | Petri | 273/73 R |
| 3,734,499 | 5/1973 | Goldstein | 273/73 R |
| 4,131,278 | 12/1978 | Goldenberg | 273/67 R |
| 4,274,634 | 6/1981 | Berluti | 273/73 L |
| 4,330,124 | 5/1982 | Vettorello | 273/67 B |
| 4,844,478 | 7/1989 | Kessler | 273/411 |
| 5,160,147 | 11/1992 | Ping . | |

*Primary Examiner*—Mark S. Graham
*Attorney, Agent, or Firm*—Kolisch, Hartwell, Dickinson, McCormack & Heuser

[57] ABSTRACT

A game paddle and a game combination wherein the paddle reacts with an impacting aerial object to cause the same to rebound along an axis generally approximating the axis of impact.

8 Claims, 1 Drawing Sheet

GAME PADDLE AND COMBINATION

This application is a continuation of my prior filed application entitled "Game Paddle and Combination", having Ser. No. 07/632,956, filed Dec. 21, 1990, which application is abandoned with filing of this continuation application.

BACKGROUND AND SUMMARY OF THE INVENTION

This invention pertains to game apparatus, and more particularly, to a unique game paddle and to a combination thereof with an aerial object such as a ball and the like.

Paddles, rackets, aerial objects and various games associated therewith have existed in myriad forms for many years—witness the tennis racket and tennis ball, badminton racket and birdie, squash racket and squash ball, ping pong paddle and ping pong ball, and so on, to form a long list of familiar entries. There is even in the known prior art patent literature a proposal for a baseball practice fielding bat wherein a stretch of taut rubber spans a hoop in a paddle frame—see U.S. Pat. No. 3,048,399.

An important characteristic of all of these devices in the prior art related field is that a selected paddle or racket is intended to produce highly controlled rebound of a related impacting aerial object. In particular, in the known art, what might be thought of as the rebound expanses in paddles are designed whereby rebound after impact approximates a performance where the axis of rebound is generally substantially a mirror image of the axis of impact (relative to a line which is normal to the usual nominal plane of the rebound expanse). It is this widely used rebound characteristic which enables, in each of the specific paddle/aerial object areas of interest, controlled, highly predictable play.

Proposed by the present invention is a unique game paddle which offers a performance that largely defies the predictable rebound performance proffered by prior art apparatus. More particularly, I have discovered that it is possible to create a game paddle, wherein a rebound expanse is formed by a low-modulus-of-elasticity material which reacts to impact of an aerial object, such as a ball, to promote rebound generally "back along" the axis of impact. This surprising behavior offers a highly entertaining and generally unpredictable type of paddle/object play activity.

Also proposed by the present invention is a novel paddle/aerial object combination for play wherein the impact interaction between the paddle and the object leads to unique play consequences. While I have found that the paddle embodying the present invention reacts with substantially all ball-like aerial objects to create the unique rebound performance, which I refer to as retro-rebound, certain kinds of ball-like aerial objects, particularly those which, upon impact, respond by significant configurational collapse, tend to rebound more precisely along the particular axis of impact. One form of such an aerial object takes the form of multiple, elongate, floppy, elastomeric filaments that radiate in substantially all directions from a dense core, very much like an object currently made available by OddzOn Products of Campbell, Calif., sold under the registered trademark KOOSH ® ball.

As mentioned, a paddle constructed in accordance with the invention, employed in combination with substantially any ball-like aerial object, offers the unique performance discussed above, and in the broadest sense of the contribution of this invention, the paddle is not limited for use with a KOOSH ®-ball-like object.

In a preferred embodiment of the invention, the paddle takes the form of a two-piece molded paddle frame, including a handle and an extension thereof forming a generally circular, or slightly ovate, hoop. Mounted on the frame, and spanning the area defined by the hoop, is an expanse, which may be either a single-layer expanse or a double-layer expanse, of an interlock, bi-axially stretchable material, such as the well-known fabric sold under the trademark LYCRA ®. This familiar fabric is a product manufactured by E. I. DuPont de Nemours & Co. Other similar materials may also be used for this expanse.

The exact phenomena explaining what one experiences with this paddle vis-a-vis retro-rebound are not known. However, observation clearly shows that the material chosen for and in the paddle's rebound expanse tends to minimize lateral roll of an impacting object. Lateral friction appears to build. A consequence of this seems to be that appreciable lateral (retro-rebound) force-loading occurs in the expanse. This can be represented as a lateral force vector which is directly opposite the incoming lateral impact force vector. Thus, an object tends to be returned generally along its incoming axis.

Various other objects and advantages which are offered by the invention will become more fully apparent as the description which now follows is read in conjunction with the accompanying drawings.

DETAILED DESCRIPTION OF THE INVENTION

Figure 1:
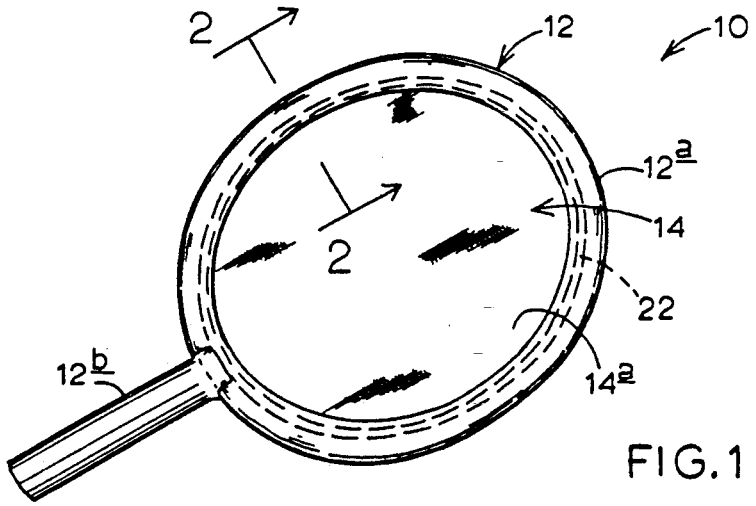
FIG. 1 is a perspective view of a game paddle constructed in accordance with the present invention.

Turning attention now to the drawings, and with reference first of all to FIG. 1, indicated generally at 10 is a game paddle constructed in accordance with the present invention. This paddle includes a frame 12 having a hoop portion **12*a* and a handle portion 12*b*, and a stretchy, elastomeric, woven-fabric web 14 which includes a rebound expanse 14*a* that spans the area circumscribed by hoop portion 12*a***.

Figure 2:
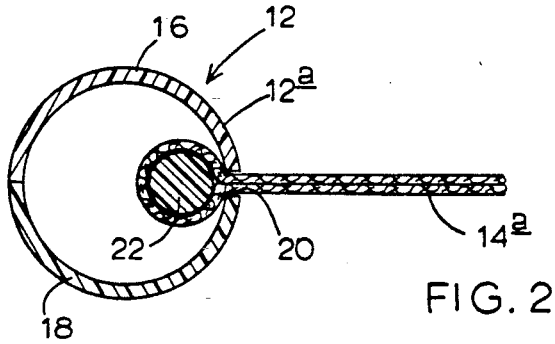
FIG. 2 is an enlarged, fragmentary section, taken generally along the line 2—2 in FIG. 1, illustrating details of construction.

Referring to FIG. 2 along with FIG. 1, according to a currently preferred method of making paddle 10, frame 12 is formed, as by molding from plastic, with two complementary facing frame components 16, 18 which are brought together during the final manufacture of the paddle and bonded to one another as by gluing. Along the outer perimeter of hoop portion **12*a*, the confronting faces of components 16, 18 abut one another. Along the inner perimeter of the hoop portion, the confronting frame components define a slender channel shown at 20 in FIG. 2**. Between the confronting faces is an open region or passage.

While various woven-fabric web materials may be used in a paddle according to the invention, the product sold under the trademark designator LYCRA®, a multi-directionally stretchy interlock material has been found to offer quite superior performance.

In the embodiment now being described, what might be thought of as a generally circular sock is formed, using the material just described, to make up the basic construction of web 14. Before complete closure of the perimeter of the sock, a dimension-setting support armature or rod, such as that shown at 22 in FIG. 2, is inserted into the interior of the sock, with the latter then completely closed up. This composite anchor structure, prior to final mating of frame components 16, 18, is fitted with armature 22 positioned to be seated just within the inner side of channel 20, and with the twin opposing expanses in the sock, passing in a somewhat compressed condition through channel 20. The final assemblage, in cross-section, is seen in FIG. 2. The sock constitutes a portion of the margin of web 14 extending beyond slot or channel 20 and the anchor structure holds a portion of the margin of the web extending laterally of the slot.

Thus, in the paddle now being described, rebound expanse 14*a* actually takes the form of two confronting layers of the woven fabric material. This construction is one which is extremely simple to implement, but not one that is required in accordance with the desired performance of the paddle of the invention. Put another way, the rebound expanse in the paddle could be formed with but a single woven fabric layer.

As has been mentioned earlier, while the paddle construction so far described has been found to offer some very unique performance characteristics with substantially any suitable aerial object, when it is combined with an object that has little tendency to bounce, such as an object which tends to collapse upon impact, its unique performance characteristics are especially pronounced.

Figure 3:
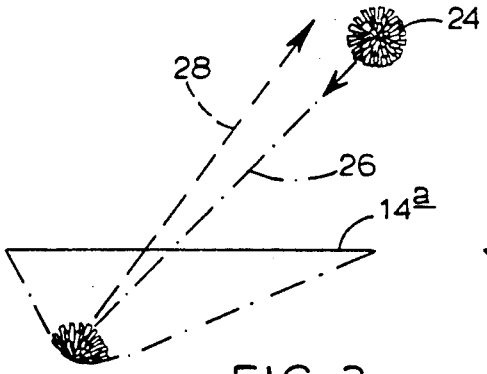
FIGS. 3 and 4, which schematically illustrate what is referred to herein as the rebound expanse in the paddle of the invention, also illustrate the combination of such paddle with a substantially non-self-bouncing aerial object as the same collides with the paddle along two different incoming axes of impact.
Figure 4:
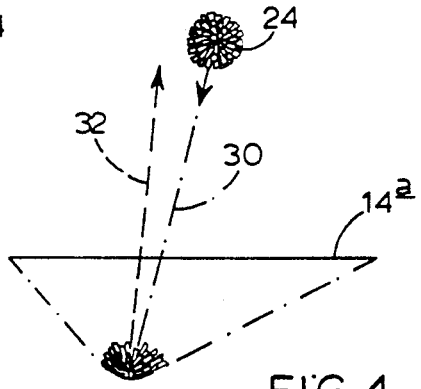

FIGS. 3 and 4 illustrate such a combination with an aerial object 24 which exhibits practically no tendency to bounce, and which upon impact tends to collapse. An object which has been found to cooperate in combination with paddle 10 extremely well is one which takes the form (object 24) of multiple, elongate, floppy, elastomeric filaments that radiate in substantially all directions from a dense core. Such an object is made available commercially by the Campbell California corporation OddzOn Products, Inc., is sold under the trademark KOOSH® ball, and is fully described in U.S. Pat. No. 4,756,529.

In FIG. 3, rebound expanse 14*a* is shown in highly schematic form, with the plane of this expanse extending normal to the plane of FIG. 3. Object 24 is shown to impact expanse 14*a* along an impact axis 26. Because of the extremely stretchy nature of the fabric making up the rebound expanse, object 24 drives a deep pocket into the expanse, collapses, and due to the unique performance of the rebound expanse, bounces back (retro-bounces) along an axis 28 which very closely matches incoming axis 26.

FIG. 4 illustrates another impact/rebound performance with object 24 impacting along a relatively steep impact axis 30, and rebounding along a closely matching rebound axis 32.

Figure 5:
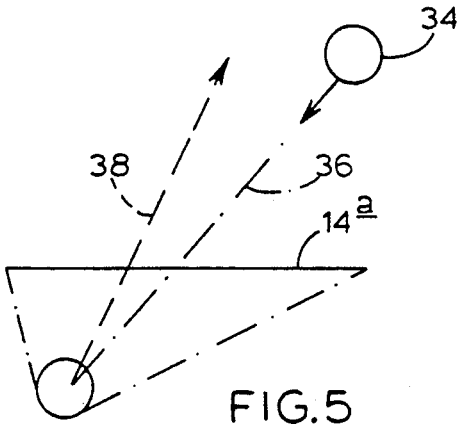
FIGS. 5 and 6 are somewhat similar to FIGS. 4 and 5, respectively, except that they illustrate how the paddle performs upon impact of a more self-bouncy aerial object, such as a conventional ball like a tennis ball.
Figure 6:
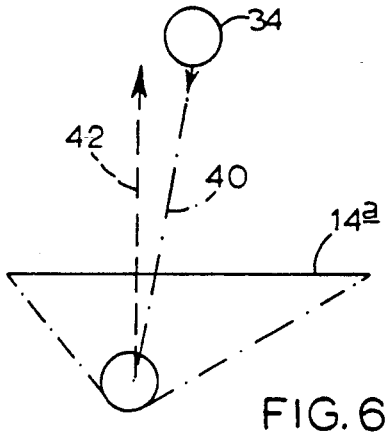

FIGS. 5 and 6 are similar, except that they illustrate performance of the rebound expanse in the paddle in conjunction with a substantially non-collapsing, relatively bouncy aerial object, such as a tennis ball like that shown at 34. In FIG. 5, ball 34 strikes along an impact axis 36, and retro-bounces along a rebound axis 38. In FIG. 6 bag 34 strikes along an impact axis 40, and returns along a rebound axis 42.

As I have attempted to depict schematically in FIGS. 3–6, inclusive, observation has shown that an aerial object having the characteristics described for object 24 tends to rebound more nearly along its axis of impact then does an object having the characteristics such as those of ball 34. Nevertheless, all aerial objects suitable for play with paddle 10 exhibit retro-rebound performance after striking the rebound expanse in the paddle.

The unique kind of play which is promoted by the paddle, and by the proposed combination of the present invention, springs largely from the retro-rebound performance mentioned above. This unique kind of rebounding action is unlike action seen to occur with known prior art game paddles and paddle/game combinations.

I recognize that while I have disclosed and described herein a preferred embodiment of the invention, variations and modifications are certainly possible without departing from the spirit of the invention.

It is claimed:

1. A game paddle for use with an aerial object such as a ball, comprising:

a frame including a hoop and a handle joined to the hoop, the hoop having an interior expanse extending thereabout and forming the perimeter of an opening encompassed by the hoop, an elongate slot extending along said interior or expanse of the hoop, the slot having opposed sides, a stretchable and resilient sheet spanning said opening in the hoop, said sheet having a marginal expanse lying within said slot between the opposed sides of the slot, and anchor structure anchoring the sheet to the hoop with the sheet extending inwardly from the slot as a substantially planar expanse over said opening, said anchor structure comprising an elongate rod extending along the hoop and positioned outwardly on the hoop from said slot, and a reversely turned portion of said sheet which fits about said rod.

2. The game paddle of claim 1, wherein said hoop is hollow by reason of an elongate passage extending along the inside of the hoop, said slot substantially throughout its length joins with said passage, and said marginal expanse of the sheet includes a portion disposed within said passage, and said anchor structure anchors said portion of said sheet disposed within said passage.

3. A game paddle comprising:

a frame including a hoop and a handle joined to said hoop, said hoop having an elongate interior expanse extending thereabout and forming the perimeter of an opening encompassed by the hoop, an elongate slot extending along said interior expanse, an elongate passage extending along the interior of the hoop extending about the hoop outwardly on the hoop from the slot, said slot along its length communicating with said passage, a stretchable and resilient sheet spanning said opening and having a marginal expanse extending within the slot, and anchor structure extending about the hoop anchoring the sheet to the hoop with the sheet in a planar condition closing off said opening, said marginal expanse of the sheet including a reversely turned portion, said anchor structure including a rod disposed within said passage, and said reversely turned portion of said sheet fitting about said rod.

4. A game paddle comprising:

a frame including a hoop and a handle joined to said hoop, the hoop having an elongate interior expanse extending thereabout forming the perimeter of an opening in the hoop, first and second layers of stretchable and resilient sheet material disposed side by side and spanning said opening in the hoop, an elongate slot extending along said hoop, said layers of sheet material each having a marginal expanse and the marginal expanses of said layers facing each other and lying within said slot, and anchor structure anchoring said marginal expanses of said layers on said hoop, disposed adjacent and outwardly of said slot.

5. The game paddle of claim 4, which further includes an elongate open region extending along the hoop outwardly of the slot and joining with the slot, said marginal expanses of said layers extending from said slot into said open region, and said anchor structure comprises an elongate rod lying in said open region engaging said expanses of said layers.

6. The game paddle of claim 5, wherein said expanses of said layers join with each other in a joinder region, and said rod extends between said expanses with said joinder region lying outwardly on the hoop from said rod.

7. A game paddle for use with an aerial object such as a ball, comprising:

a frame including a hoop and a handle joined to the hoop, the hoop having an interior expanse extending thereabout and forming the perimeter of an opening encompassed by the hoop, an elongate slot extending along said interior expanse of the hoop, the slot having opposed sides, a stretchable and resilient sheet spanning said opening in the hoop, said sheet having a marginal expanse lying within said slot and between the opposed sides of the slot, and anchor structure anchoring the flexible sheet to the hoop with the sheet extending inwardly from the slot as a substantially planar expanse over said opening, said marginal expanse of the sheet including a portion extending beyond said slot, and said anchor structure having a construction that holds said portion of said marginal expanse with said portion extending laterally of the slot sides.

8. A game paddle comprising:

a frame including a hoop and a handle joined to said hoop, said hoop having an elongate interior expanse extending thereabout and forming the parameter of an opening encompassed by the hoop, an elongate slot extending along said interior expanse, an elongate open region extending about the hoop, outwardly on the hoop from the slot, a stretchable and resilient sheet spanning said opening and having a marginal expanse extending within the slot, and anchor structure extending about the hoop anchoring the sheet to the hoop with the sheet in a planar condition closing off said opening, said marginal expanse including a portion extending beyond said slot and said anchor structure being lodged in said open region and holding said portion of said expanse deflected laterally of the slot in said open region.

* * * * *